US009130282B2

(12) United States Patent
Suzuki et al.

(10) Patent No.: US 9,130,282 B2
(45) Date of Patent: Sep. 8, 2015

(54) TERMINAL FITTING WITH ELECTRIC WIRE

(75) Inventors: Masakazu Suzuki, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 306 days.

(21) Appl. No.: 13/813,324

(22) PCT Filed: Apr. 21, 2011

(86) PCT No.: PCT/JP2011/059824

§ 371 (c)(1),
(2), (4) Date: Jan. 30, 2013

(87) PCT Pub. No.: WO2012/029352

PCT Pub. Date: Mar. 8, 2012

(65) Prior Publication Data

US 2013/0126236 A1 May 23, 2013

(30) Foreign Application Priority Data

Sep. 1, 2010 (JP) ..... 2010-195935

(51) Int. Cl.
*H01R 4/18* (2006.01)
*H01R 4/10* (2006.01)
*H01R 13/436* (2006.01)

(52) U.S. Cl.
CPC ..... *H01R 4/18* (2013.01); *H01R 4/185* (2013.01); *H01R 13/4362* (2013.01)

(58) Field of Classification Search
CPC ..... H01R 4/18; H01R 4/183; H01R 4/184; H01R 4/185; H01R 4/2437
USPC ..... 174/84 C; 439/877, 878, 882
See application file for complete search history.

(56) References Cited

U.S. PATENT DOCUMENTS 5,516,311 A * 5/1996 Maejima ..... 439/877
6,004,171 A * 12/1999 Ito et al. ..... 439/877

(Continued)

FOREIGN PATENT DOCUMENTS

JP 2003-331940 11/2003
JP P2008-066156 A 3/2008

(Continued)

OTHER PUBLICATIONS

Japanese Office Action—Jun. 17, 2014.

(Continued)

*Primary Examiner* — Sherman Ng
(74) *Attorney, Agent, or Firm* — Gerald E. Hespos; Michael J. Porco; Matthew T. Hespos

(57) ABSTRACT

A coupling portion is approximately U-shaped with two side plates extending up from a bottom plate. Front and rear ends of the bottom plate are respectively joined to a bottom wall of a box and a mounting plate of a crimping portion. Front and rear ends of the side plates are respectively joined to side walls of the box and crimping pieces of the crimping portion. In the crimping portion, an electric wire is crimped by wrapping the first crimping pieces around a terminal portion of the electric wire mounted on a mounting plate while deforming and bending them. In respective end edges of the side plates in an upward extending direction, reinforcing portions are formed continuously extending from respective front ends that are joined to the side walls to rear ends that are joined to the crimping pieces and having regions that are bent inward.

4 Claims, 13 Drawing Sheets

(56) References Cited

U.S. PATENT DOCUMENTS

| | | | | |
|---|---|---|---|---|
| 6,659,811 | B2 | 12/2003 | Okamoto et al. | |
| 7,419,409 | B2 * | 9/2008 | Machida et al. | 439/852 |
| 7,601,035 | B2 | 10/2009 | Takahashi et al. | |
| 7,811,140 | B2 | 10/2010 | Tabata et al. | |
| 2002/0081913 | A1 * | 6/2002 | Tabata et al. | 439/752 |
| 2003/0087562 | A1 | 5/2003 | Okamoto et al. | |
| 2005/0032440 | A1 * | 2/2005 | Kurimoto | 439/839 |
| 2006/0172615 | A1 * | 8/2006 | Noro et al. | 439/843 |
| 2008/0096442 | A1 * | 4/2008 | Fukaya et al. | 439/852 |

FOREIGN PATENT DOCUMENTS

| | | |
|---|---|---|
| JP | 2009-93811 | 4/2009 |
| JP | 2010-40455 | 2/2010 |
| JP | P2010-165514 | 7/2010 |
| WO | 2004/114469 | 12/2004 |

OTHER PUBLICATIONS

International Search Report of Jul. 26, 2011.

* cited by examiner

TERMINAL FITTING WITH ELECTRIC WIRE

BACKGROUND OF THE INVENTION

1. Field of the Invention

The present invention relates to a terminal fitting with an electric wire.

2. Description of the Related Art

WO 2004/114469 discloses a terminal fitting with an electric wire, which includes an angular tube-like box portion, a coupling portion that is joined to a rear end of the box portion and has an approximately U-shaped cross section, and an open-barrel type crimping portion that is joined to a rear end of the coupling portion, and in which a terminal portion of the electric wire is fastened to the crimping portion so that electrical conduction can be established.

In this terminal fitting with the electric wire, the coupling portion is reinforced by forming respective plate-like portions in left and right side plate portions constituting the coupling portion and coupling the respective plate-like portions to crimping pieces constituting the crimping portion by the coupling portion. However, since the coupling portion has a flat plate-like shape, a significant increase in the strength thereof cannot be expected.

The present invention has been accomplished based on circumstances as described above, and it is an object thereof to reliably reinforce the coupling portion.

SUMMARY OF THE INVENTION

A terminal fitting with an electric wire of the present invention includes a terminal fitting that is elongated in a front-rear direction as a whole and that has an angular tube-like box portion, an open-barrel type crimping portion disposed to a rear of the box portion, and a coupling portion coupling a rear end of the box portion and a front end of the crimping portion to each other, and an electric wire that is fastened to the terminal fitting so as to connect to the terminal fitting electrically. The coupling portion is approximately U-shaped with a pair of side plate portions extending upward from respective side edges of a bottom plate portion. A front end and a rear end of the bottom plate portion are respectively joined to a bottom wall portion constituting the box portion and a mounting plate portion constituting the crimping portion. Front ends and rear ends of the side plate portions are respectively joined to side wall portions extending upward from respective side edges of the bottom wall portion and crimping pieces extending upward from respective side edges of the mounting plate portion. In the crimping portion, the electric wire is crimped by wrapping the crimping pieces around a terminal portion of the electric wire mounted on the mounting plate portion while deforming and bending the crimping pieces. In respective end edge portions of the side plate portions in an upward extending direction, reinforcing portions are formed continuously extending from respective front ends that are joined to the side wall portions to rear ends that are joined to the crimping pieces and constituting regions that are deformed and bent inward along with respective front ends of the crimping pieces in a state in which the electric wire is crimped by the crimping pieces, and portions in which the reinforcing portions and the respective crimping pieces are continuous with each other are present in a face opposing the bottom plate portion.

The coupling portion is reinforced by the reinforcing portions, and since the reinforcing portions continuously extend from the respective front ends that are joined to the side wall portions of the box portion to the rear ends that are joined to the crimping pieces of the crimping portion and have the regions that are bent inward, the reinforcing portions have high rigidity and can reliably reinforce the coupling portion.

The following configurations may be added to the terminal fitting with an electric wire of the present invention.

The height of the reinforcing portions relative to the bottom plate portion is lower than that of the side wall portions of the box portion at the respective front ends of the reinforcing portions and increases toward a rear end side. In this manner, the height of the reinforcing portions at the respective front ends thereof is lower than that of the side wall portions of the box portion, and therefore it is possible to allow a rear end edge of the box portion to function as a locking portion for locking on other members. Here, since the height of the reinforcing portions gradually increases toward the rear end side, the overall rigidity of the reinforcing portions is enhanced when compared to cases where the height is constant all the way from the front ends to the rear ends. Therefore, according to the present invention, it is possible to ensure a large locking area for locking on other members at the rear end of the box portion without decreasing the reliability of the reinforcing portions.

In front end portions of the reinforcing portions, respective end edges of the side plate portions in the upward extending direction are curved so as to be continuous with rear end edges of the side wall portions. In this manner, in the front end portions of the reinforcing portions, the respective end edges in the upward extending direction from the bottom plate portion are curved so as to be smoothly joined to the rear end edges of the side wall portions, and therefore, stress concentration on the front end portions of the reinforcing portions is alleviated, and deformation and the like due to stress concentration can be prevented.

The height of the front end portions of the reinforcing portions relative to the bottom plate portion is set to be lower than that of the side wall portions of the box portion, thereby allowing the rear end edge of the box portion to serve as a locking portion, and in a state in which the terminal fitting is inserted in a housing, a retainer attached to the housing locks the locking portion from the rear, thereby preventing the terminal fitting from disengaging from the housing, and the retainer is in contact with the reinforcing portions or is located in close proximity to and opposes the reinforcing portions. In this manner, in the state in which disconnection of the terminal fitting inserted in the housing is prevented by the retainer, even if the terminal fitting is displaced in a direction intersecting the length direction of the terminal fitting, the displacement of the terminal fitting can be restricted or suppressed by the retainer being brought into contact with the reinforcing portions.

DETAILED DESCRIPTION OF THE PREFERRED EMBODIMENTS

Figure 1:
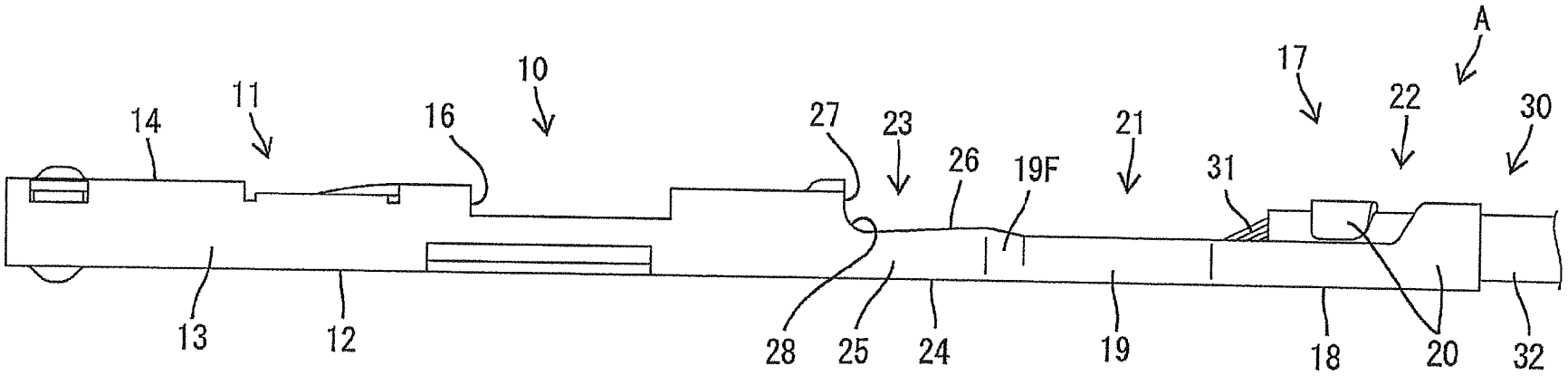
FIG. 1 is a side view of a terminal fitting with an electric wire in accordance with an embodiment of the insertion.
Figure 2:
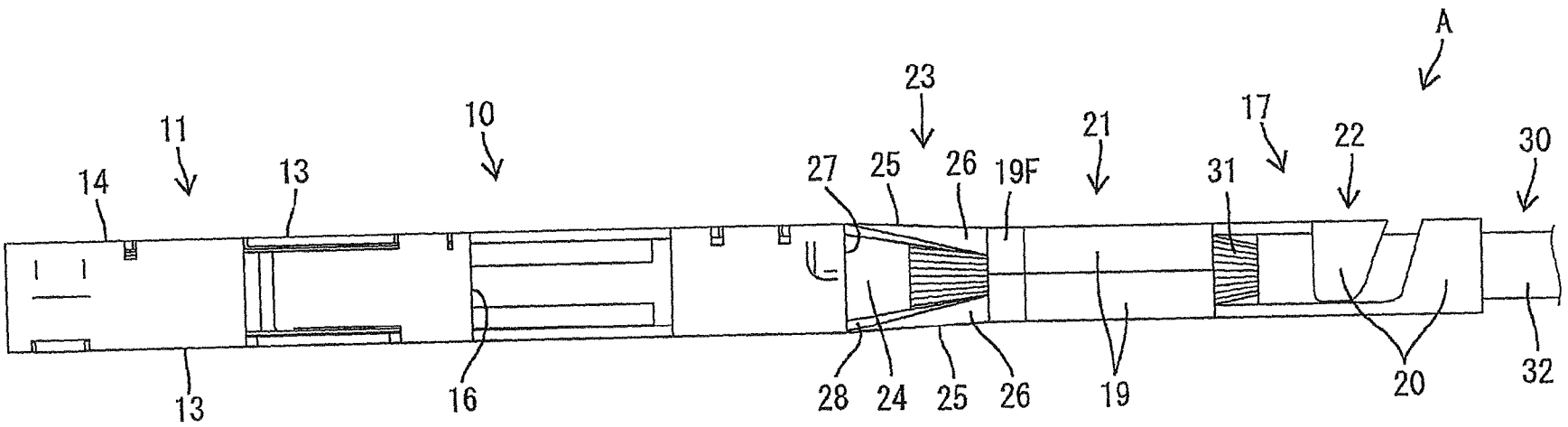
FIG. 2 is a plan view of the terminal fitting with the electric wire.

Hereinafter, a terminal fitting with an electric wire in which the present invention is embodied will be described with reference to FIGS. 1 to 16. As shown in FIGS. 1 and 2, a terminal fitting with an electric wire A of this embodiment includes a terminal fitting 10 that is shaped into an elongated shape that is elongated in a front-rear direction by, for example, bending a metal plate material (see FIG. 5) stamped into a predetermined shape and an electric wire 30 that is fastened to a rear end portion of the terminal fitting 10 and extends rearward in a length direction of the terminal fitting 10.

The terminal fitting 10 has an angular tube-like box portion 11 disposed at its front end portion (the end portion on the left-hand side in FIGS. 1 and 2), an open-barrel type crimping portion 17 disposed to the rear of the box portion 11, and a coupling portion 23 coupling a rear end of the box portion 11 and a front end of the crimping portion 17 to each other. The box portion 11 includes a bottom wall portion 12 that is elongated in the front-rear direction, a pair of left and right side wall portions 13 extending upward from left and right side edges, respectively, of the bottom wall portion 12 at approximately right angles thereto, and an upper wall portion 14 extending from respective upper end edges (end edges in an upward extending direction) of the side wall portions 13 at approximately right angles thereto (in approximately parallel to the bottom wall portion 12). An elastic contact strip 15 is accommodated in the box portion 11, which extends rearward from a front end edge of the upper wall portion 14, folded back at that front end edge. A tab of a mating terminal (omitted from the drawings) inserted from the front into the box portion 11 will be elastically sandwiched between the elastic contact strip 15 and the bottom wall portion 12 so that electrical conduction can be established. A primary locking portion 16 for locking on a lance 42, which will be described later, is formed in the box portion 11 by cutting out a portion of the upper wall portion 14 and the side wall portions 13.

The crimping portion 17 is composed of a mounting plate portion 18 that is elongated in the front-rear direction, a pair of symmetrical left and right first crimping pieces 19 extending upward from respective front end-side regions of left and right side edges of the mounting plate portion 18, and a pair of asymmetrical left and right second crimping pieces 20 extending upward from respective rear end-side regions of the left and right side edges of the mounting plate portion 18. A front end-side region of the mounting plate portion 18 and the first crimping pieces 19 constitute a wire barrel portion 21, and a rear end-side region of the mounting plate portion 18 and the second crimping pieces 20 constitute an insulation barrel portion 22. A front end portion (terminal portion) of the electric wire 30 is crimped to this crimping portion 17 by an automatic crimping machine (omitted from the drawings) called "applicator" so that electrical conduction can be established.

The electric wire 30 is an electric wire having a well-known form in which a conductor 31 is surrounded by an insulating sheath 32. As shown in FIG. 2, in the front end portion of the electric wire 30, the insulating sheath 32 is removed from a region that is slightly longer than the front-rear length of the wire barrel portion 21, so that the conductor 31 is exposed (stripped). Crimping of this electric wire 30 is performed by mounting the exposed portion of the conductor 31 on a region of the mounting plate portion 18 that corresponds to the wire barrel portion 21, then fastening the left and right first crimping pieces 19 to the conductor 31 while deforming and bending those crimping pieces so that they are wrapped around (surround) the conductor 31, and fastening the left and right second crimping pieces 20 to a portion of the electric wire 30 that is surrounded by the insulating sheath 32 while deforming and bending those crimping pieces so that they are wrapped around (surround) this portion.

This crimping process results in a state in which, in the wire barrel portion 21, the pair of first crimping pieces 19 are symmetrically deformed and bent, and respective extending end portions of the first crimping pieces 19 bite into an upper face of the conductor 31 with their faces on the outer side in bending direction brought into contact with each other. On the other hand, in the insulation barrel portion 22, the two second crimping pieces 20 whose positions are offset in the front-rear direction are wrapped around an outer circumference of the insulating sheath 32.

Figure 9:
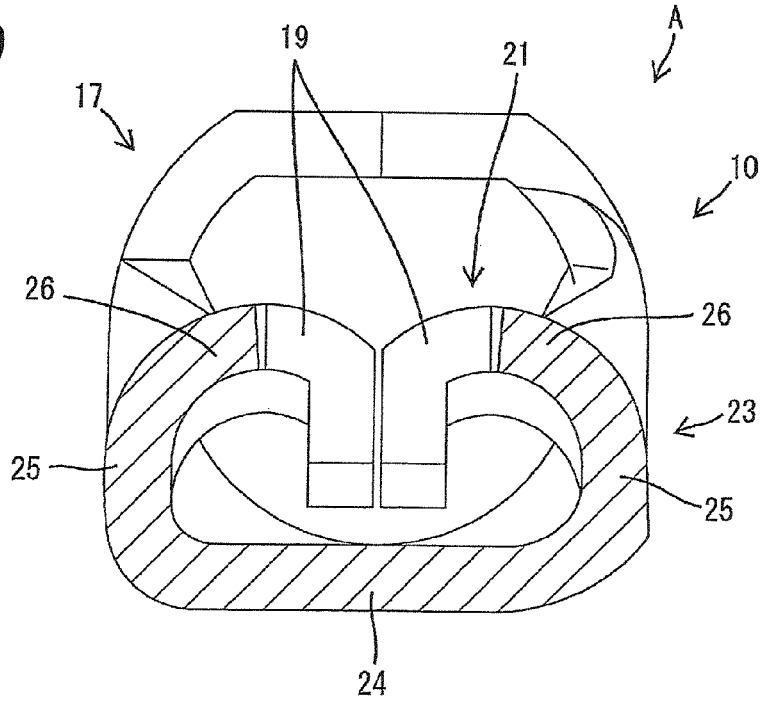
FIG. 9 is a cross-sectional view taken along line X-X in FIG. 7.
Figure 10:
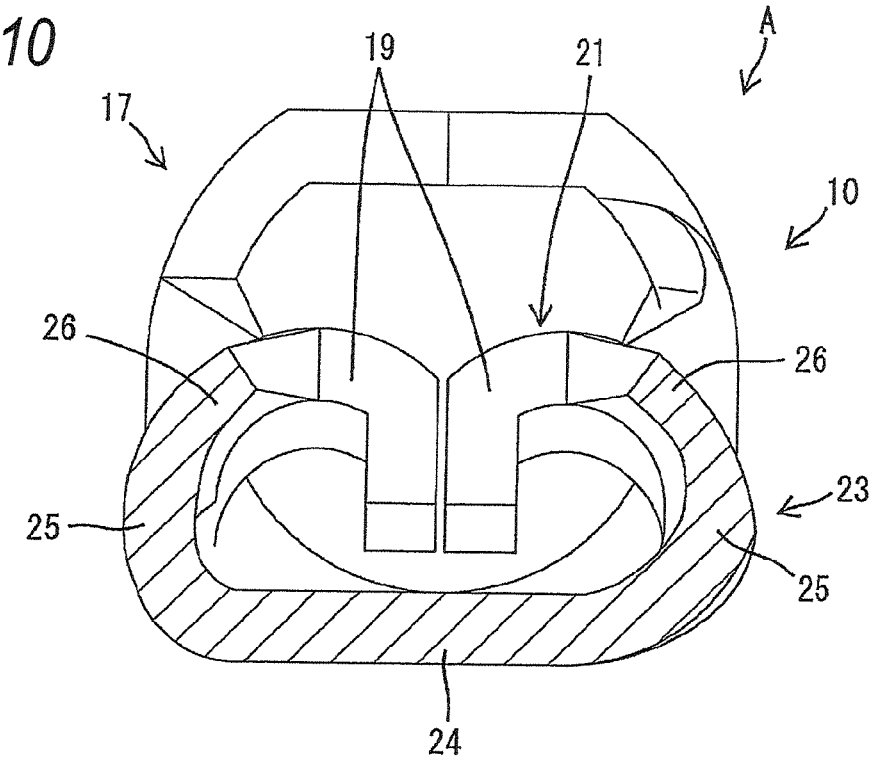
FIG. 10 is a cross-sectional view taken along line Y-Y in FIG. 7.
Figure 11:
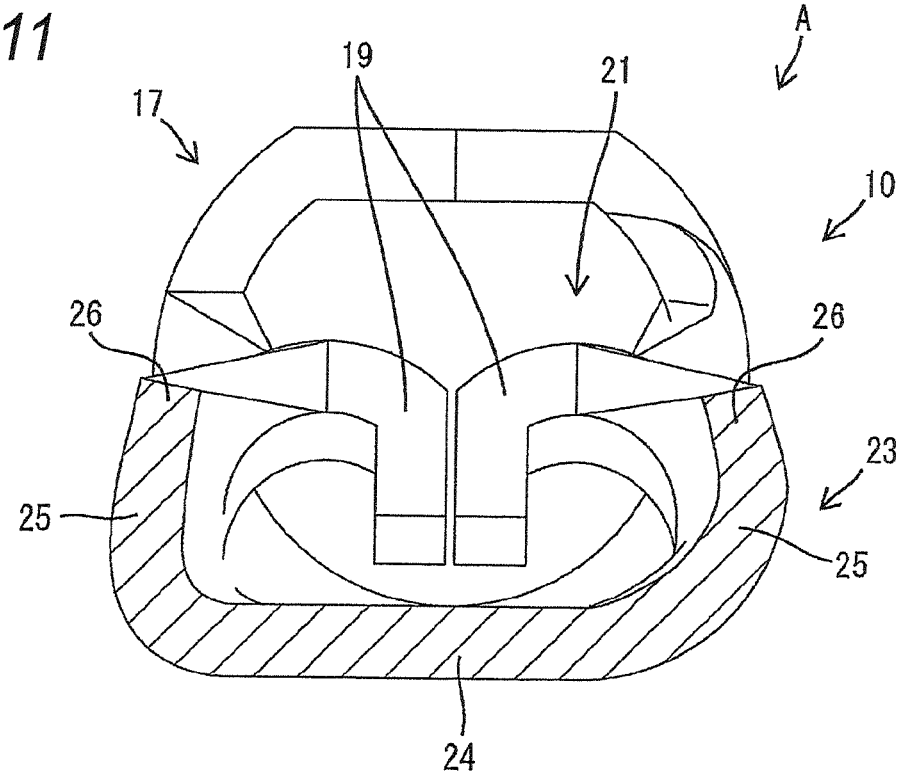
FIG. 11 is a cross-sectional view taken along line Z-Z in FIG. 7.

The coupling portion 23 includes a bottom plate portion 24 that is elongated in the front-rear direction, a pair of left and right side plate portions 25 that are formed so as to extend upward from left and right side edges, respectively, of the bottom plate portion 24 at approximately right angles thereto and be elongated in the front-rear direction, and reinforcing portions 26 for reinforcing the entire coupling portion 23. A front end of the bottom plate portion 24 is joined to and is flush with a rear end of the bottom wall portion 12 of the box portion 11, and a rear end of the bottom plate portion 24 is joined to a front end of the mounting plate portion 18 of the crimping portion 17. Front ends of the side plate portions 25 are joined to and are flush with respective rear ends of the side wall portions 13 of the box portion 11, and rear ends of the side plate portions 25 are joined to and are generally flush with respective front ends of the front-side crimping pieces. As shown in FIGS. 9 to 11, a portion of the coupling portion 23 that is composed of the bottom plate portion 24 and the left and right side plate portions 25 has a generally U-shaped cross section.

Figure 3:
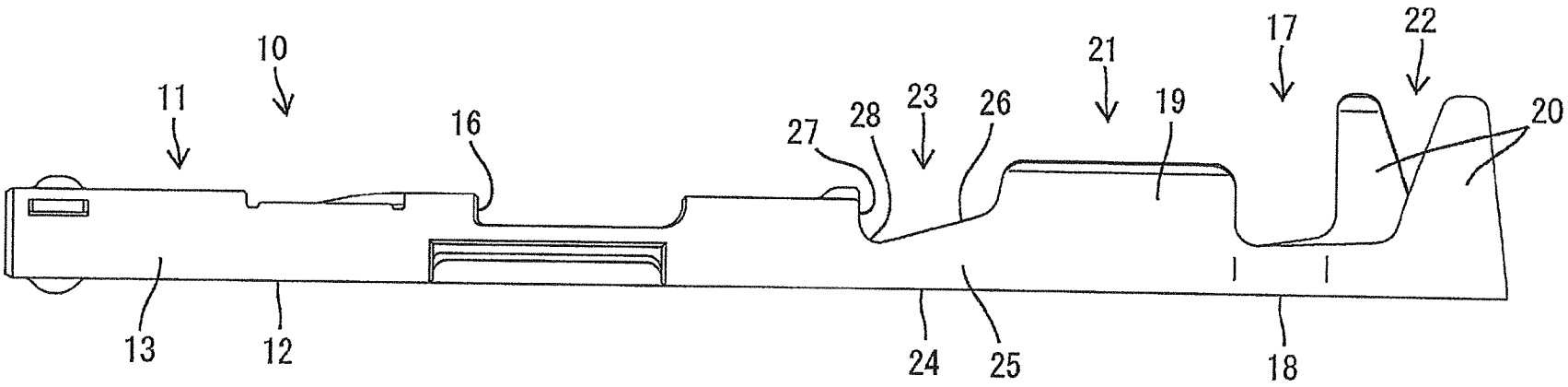
FIG. 3 is a side view of the terminal fitting, showing a state before the electric wire is connected thereto.
Figure 6:
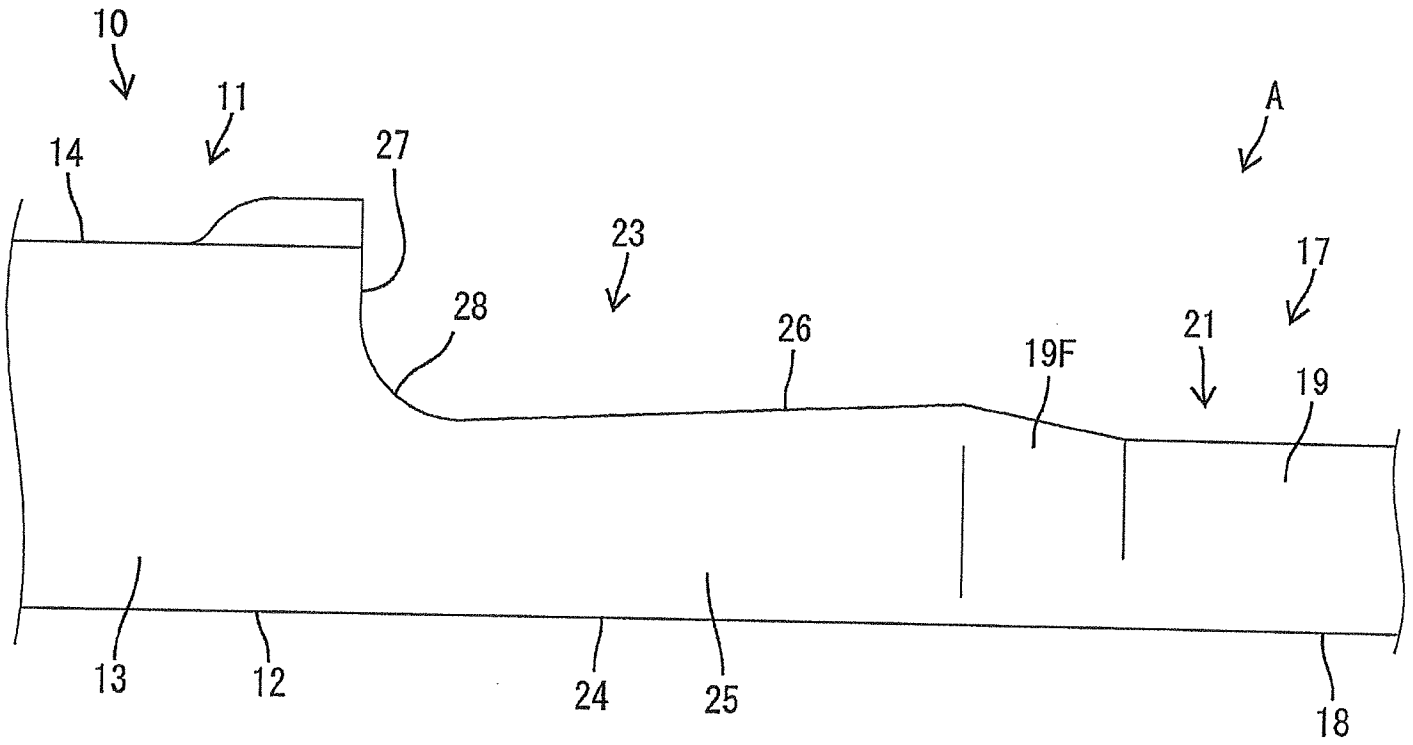
FIG. 6 is a partial enlarged view of FIG. 1, showing a reinforcement structure for a coupling portion.
Figure 7:
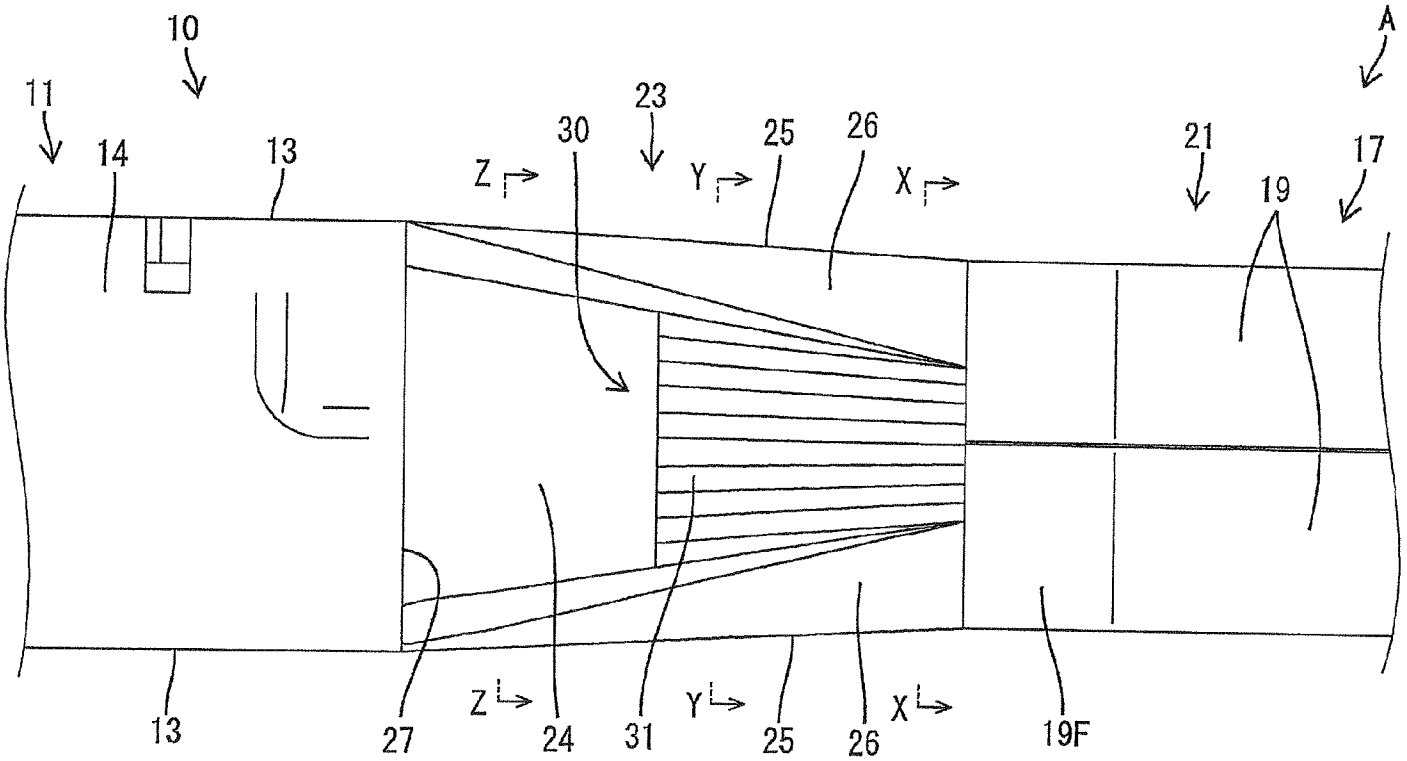
FIG. 7 is a partial enlarged view of FIG. 2, showing the reinforcement structure for the coupling portion.
Figure 8:
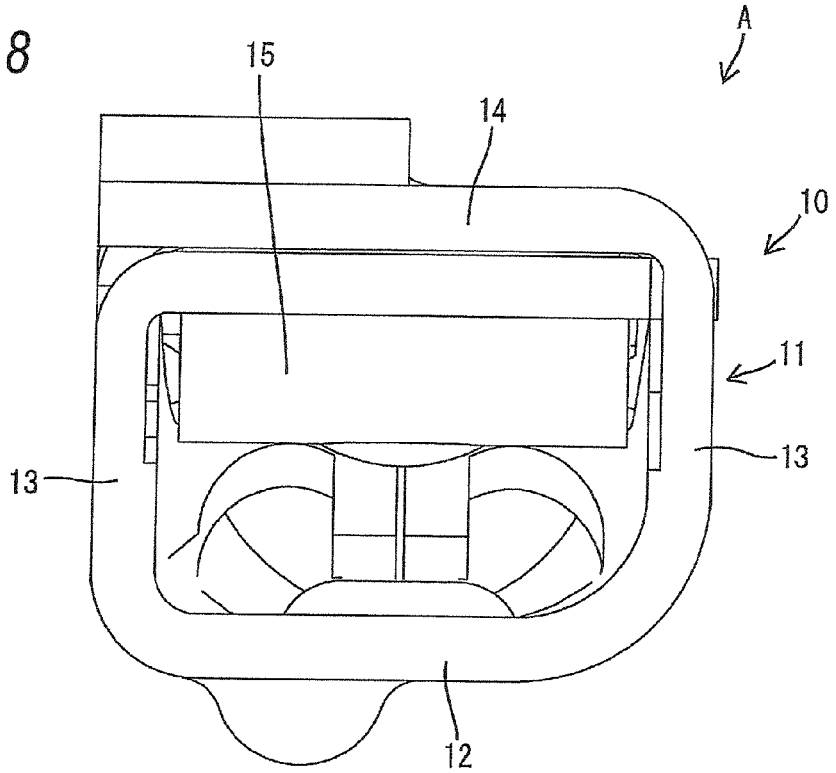
FIG. 8 is a front view of the terminal fitting with the electric wire.

As shown in FIGS. 1, 3, and 6, the height (upward extending length) of the side plate portions 25 from the bottom plate portion 24 is set to be smaller than the height of the side wall portions 13, and thus, a difference in height is created as a step between an upper face of the box portion 11 and the respective upper end edges (end edges in the upward extending direction) of the side plate portions 25. This difference in height enables a space for disposing a disconnection preventing portion 52 of a retainer 50, which will be described later, to be ensured above the coupling portion 23 and enables, in a rear end portion of the box portion 11, a secondary locking portion 27 (locking portion serving as a constituent feature of the present invention) that faces this disconnection preventing space and can lock on the disconnection preventing portion 52 to be formed.

Figure 4:
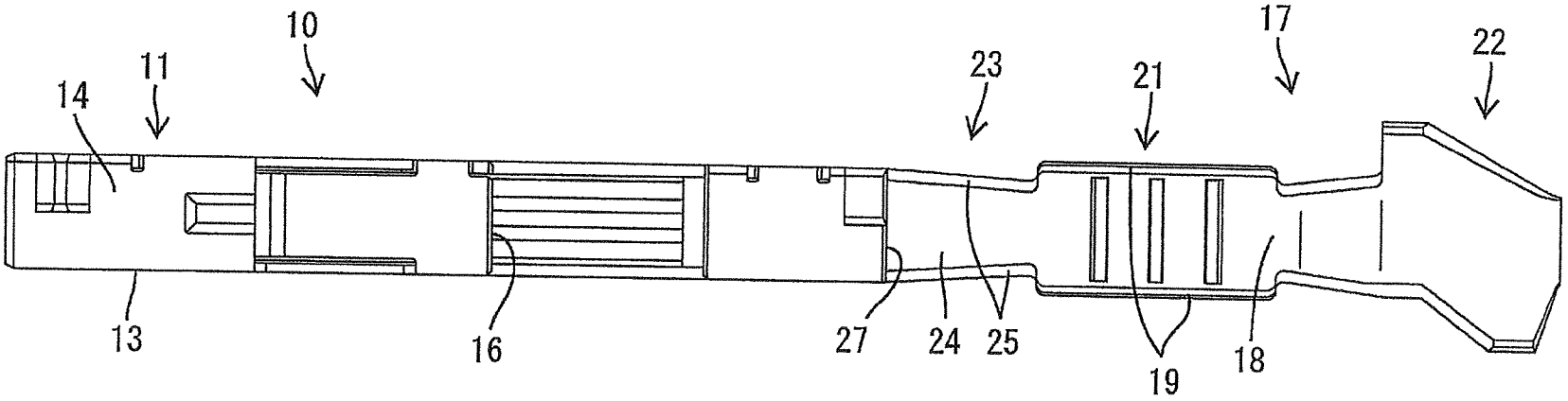
FIG. 4 is a plan view of the terminal fitting, showing a state before the electric wire is connected thereto.
Figure 5:
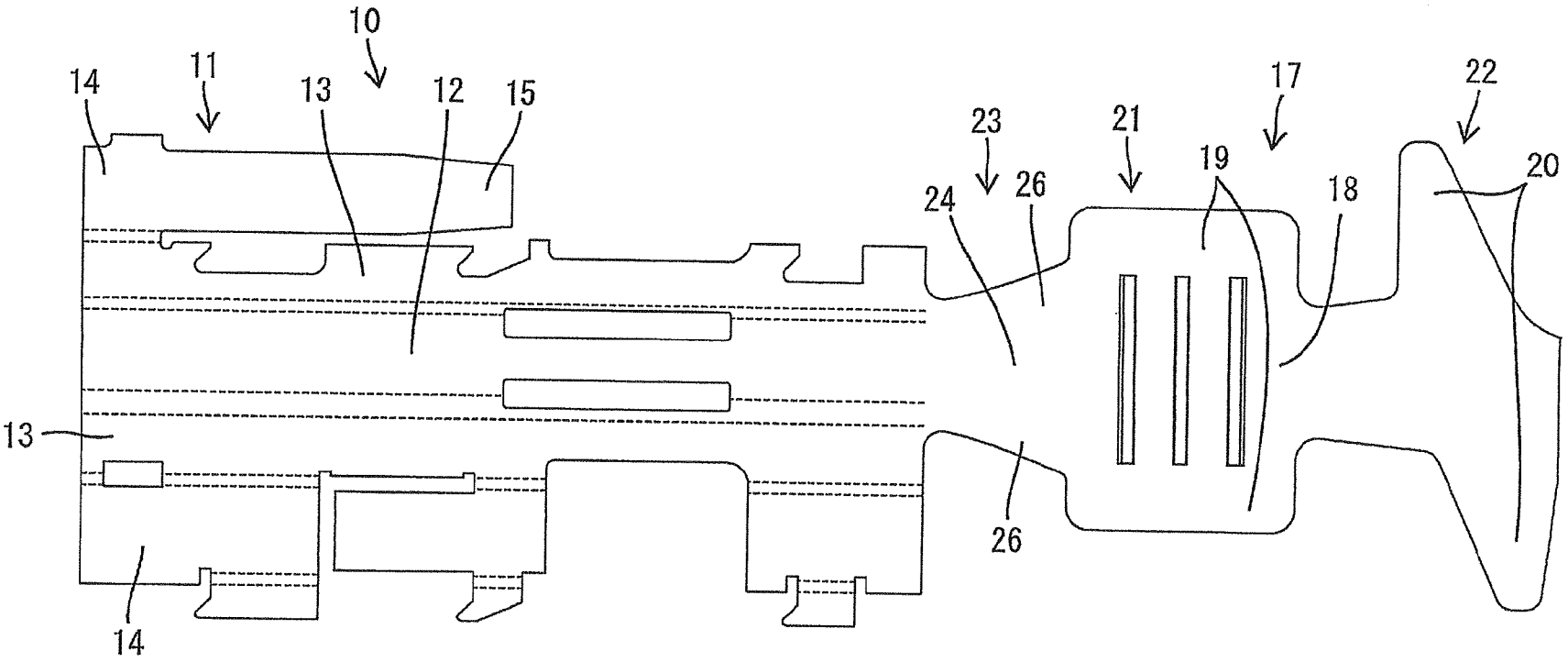
FIG. 5 is a development of the terminal fitting.

The reinforcing portions 26 are formed so as to be joined to the respective upper end edge portions of the left and right side plate portions 25 and are symmetrical to each other. Each reinforcing portion 26 continuously extends over its entire length from the front end to the rear end of the corresponding side plate portion 25 (the coupling portion 23). Accordingly, the respective front ends of the reinforcing portions 26 are joined to the rear end edges of the side wall portions 13 of the box portion 11, and the respective rear ends of the reinforcing portions 26 are joined to the front end edges of the first crimping pieces 19 of the crimping portion 17. In a state before the electric wire 30 is crimped to the crimping portion 17, as shown in FIGS. 3 and 4, the reinforcing portions 26 have a flat plate-like shape and are joined to and are flush with the respective side plate portions 25. When the terminal fitting 10 is viewed from a side, in the respective front end portions of the reinforcing portions 26, end edges in the upward extending direction from the bottom plate portion 24 are curved so as to be smoothly joined to the respective rear end edges of the side wall portions 13, and this form enables the respective front end portions of the reinforcing portions 26 to serve as stress alleviation portions 28.

Similarly, in a state before the electric wire 30 is crimped, those regions of the respective upper end edges of the reinforcing portions 26 that are rearward of the stress alleviation portions 28 are inclined with a constant gradient (angle of inclination) so that the height of these regions gradually increases toward their respective rear ends. In the inclined regions rearward of the stress alleviation portions 28, the height of the upper end edges at respective front ends of these regions is lower than that of the side wall portions 13. Also, the height of the upper end edges at respective rear ends of the reinforcing portions 26 is lower than that of the upper ends of the first crimping pieces 19.

The reinforcing portions 26 are each shaped into a bent shape in the process of crimping the electric wire 30 to the crimping portion 17. As described above, in the crimping process, the first crimping pieces 19 are deformed and bent inward so as to be wrapped around the conductor 31 and bite into the upper face of the conductor 31, but since the rear ends of the reinforcing portions 26 are directly joined to the front end edges of the first crimping pieces 19, the reinforcing portions 26 also follow the deformation of the first crimping pieces 19 and are deformed and bent inward. Although this deformation occurs in regions ranging from the respective rear ends to the front end portions of the reinforcing portions 26, the stress alleviation portions 28 may also be configured to be deformed and bent or may not be configured to be deformed and bent. Moreover, during crimping, bell-mouth portions 19F whose diameter increases toward the front are formed in the respective front end portions of the first crimping pieces 19, and the rear ends of the reinforcing portions 26 are accordingly joined to respective front ends of these bell-mouth portions 19F.

As shown in FIGS. 7 and 9 to 11, the dimension of the deformed and bent reinforcing portions 26 in a left-and-right direction (width direction) gradually increases from the front ends toward the rear ends. Moreover, as shown in FIG. 6, when viewed from a side, in those regions of the respective upper end edges of the reinforcing portions 26 that are rearward of the stress alleviation portions 28, the height of the upper end edges of the reinforcing portions 26 relative to the bottom plate portion 24 gradually increases from the front ends toward the rear ends. That is to say, the upper end edges of the reinforcing portions 26 are inclined with an approximately constant angle. Moreover, the height of respective rear ends of the upper end edges of the reinforcing portions 26 is equal to the height of the front ends (the bell-mouth portions 19F) of the first crimping pieces 19. Furthermore, as shown in FIGS. 9 to 11, in cross sections cut at right angles to the length direction of the terminal fitting 10, respective formation regions of the reinforcing portions 26 (the length in a direction along the circular arc) increase from the front end side toward the rear ends.

The terminal fitting with the electric wire A is configured to be inserted in a housing 40. As shown in FIGS. 12 to 15, a plurality of cavities 41 passing through the housing 40 in the front-rear direction and divided into three rows in a vertical direction are formed in the housing 40, and the terminal fitting with the electric wire A is configured to be inserted in a cavity 41 from the rear. The terminal fitting with the electric wire A inserted in the cavity 41 is held in a disconnection preventing state in which disconnection thereof is prevented, by the lance 42 formed along an inner wall of the cavity 41 locking the primary locking portion 16.

Moreover, an accommodation space 43 that opens at an outer side face of the housing 40 and communicates with the cavities 41 is formed in the housing 40. This accommodation space 43 is configured to accommodate a portion of the retainer 50 that can prevent disconnection of the terminal fitting 10. Moreover, as shown in FIGS. 13 and 14, within the accommodation space 43, a temporary locking portion 44 is formed by cutting out a portion in the vicinity of the opening face of the accommodation space 43, and a permanent locking portion 45 is formed by cutting out a portion at a location further inside than the temporary locking portion 44.

Figure 13:
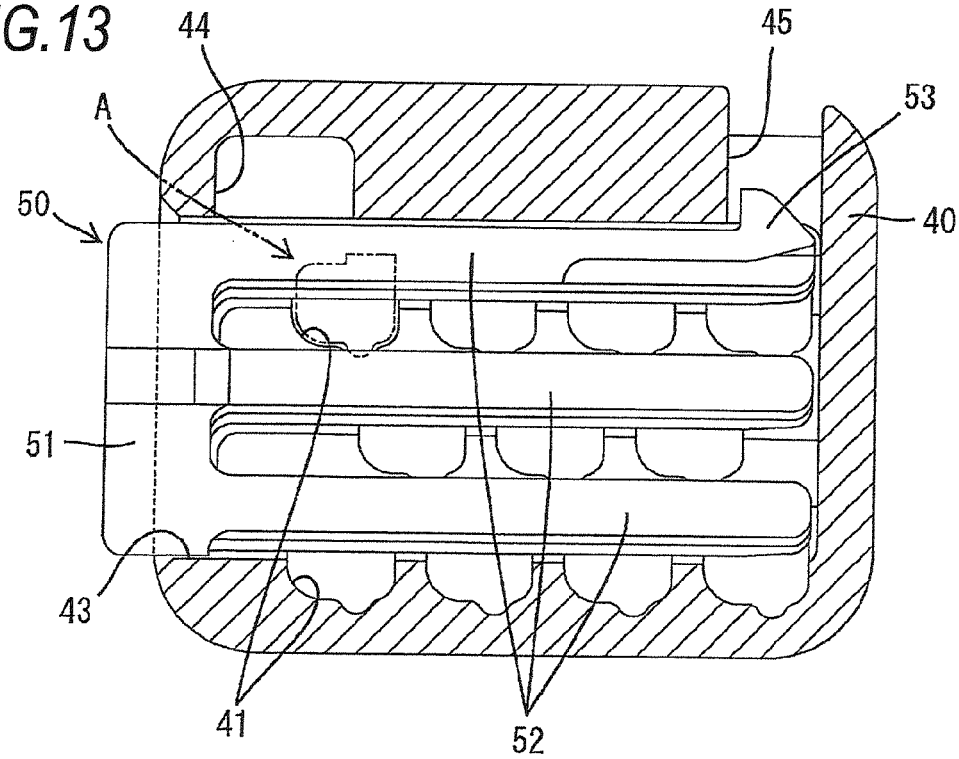
FIG. 13 is a cross-sectional view taken in a direction orthogonal to the length direction of the terminal fitting, showing a state in which the retainer is permanently locked in a housing.
Figure 14:
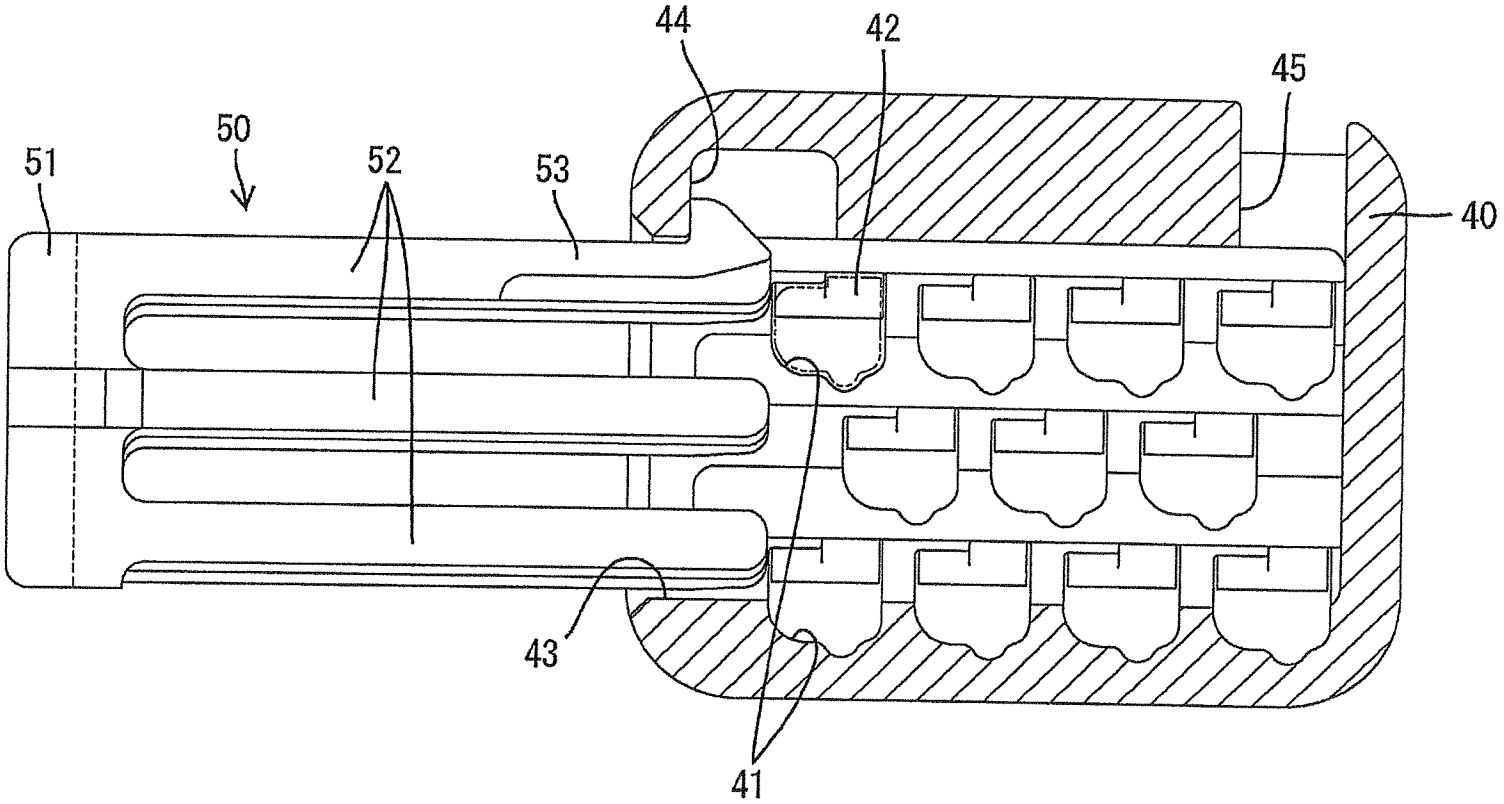
FIG. 14 is a cross-sectional view taken in the direction orthogonal to the length direction of the terminal fitting, showing a state in which the retainer is temporarily locked in the housing.
Figure 15:
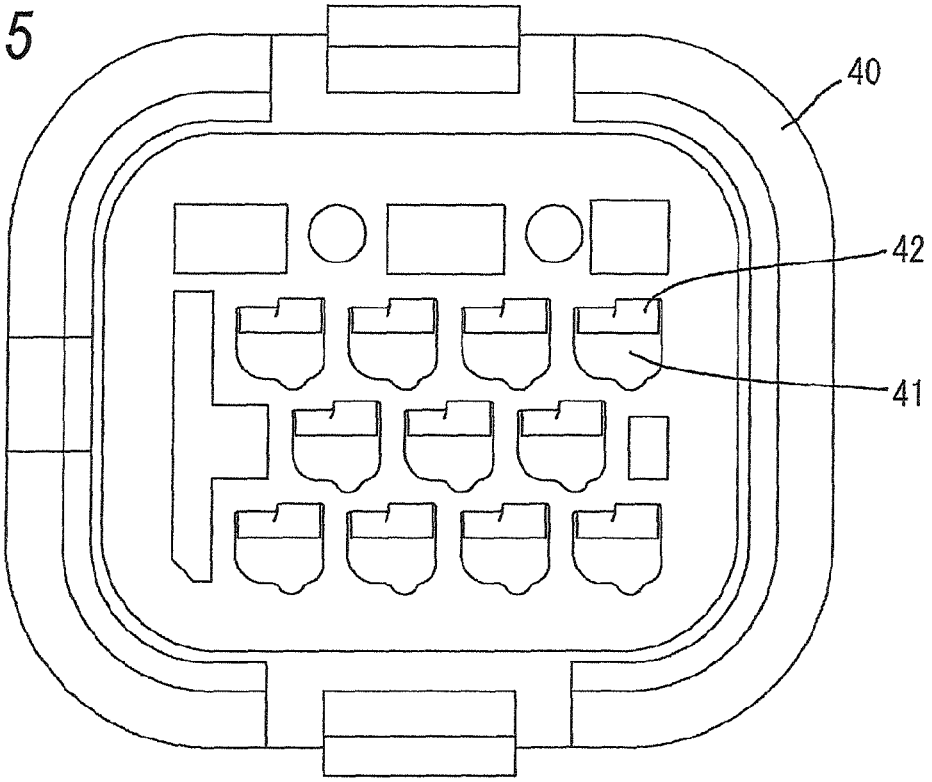
FIG. 15 is a front view of the housing.
Figure 16:
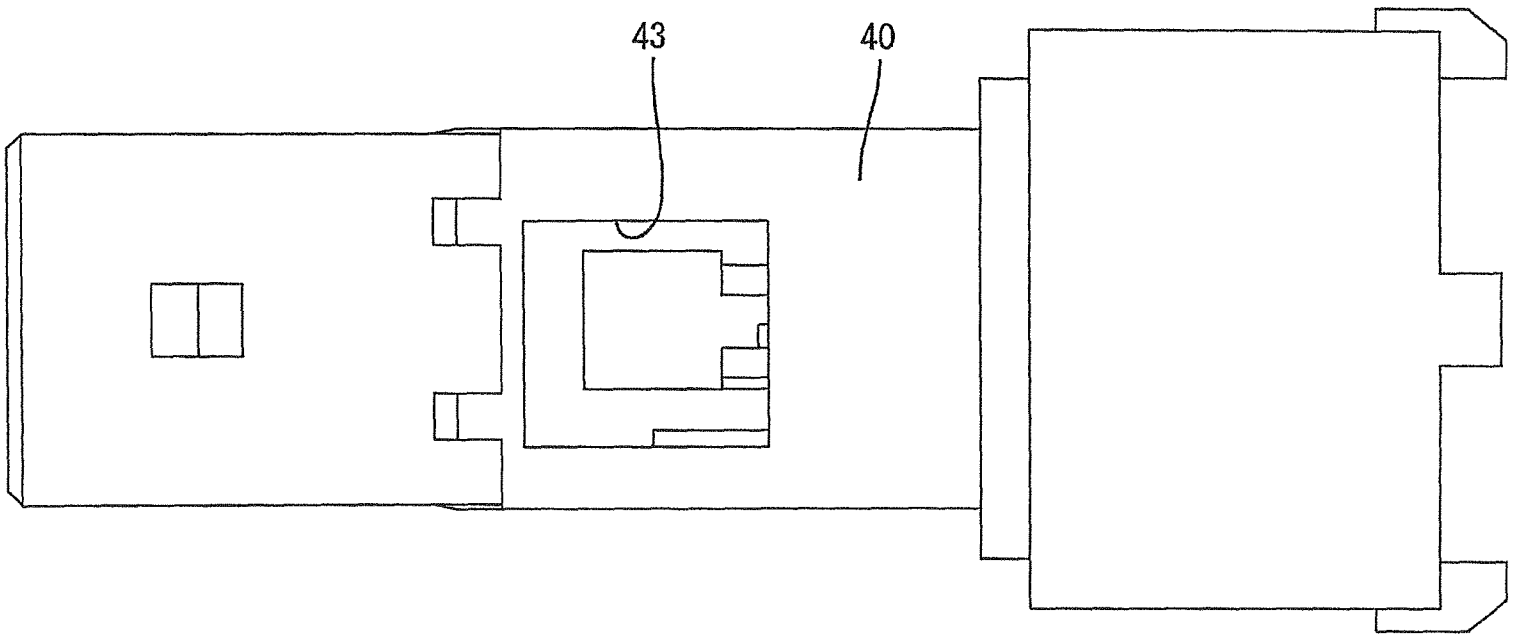
FIG. 16 is a side view of the housing.

As shown in FIGS. 13 and 14, in the retainer 50, a support plate portion 51 whose plate thickness direction corresponds to the left-and-right direction and three disconnection preventing portions 52 that are cantilevered laterally from the support plate portion 51 are formed. Each disconnection preventing portion 52 is in the form of a plate whose plate thickness direction corresponds to the vertical direction, and the three disconnection preventing portions 52 are vertically spaced apart so as to correspond to the cavities 41. Moreover, a portion of the uppermost disconnection preventing portion 52 serves as an elastic locking piece 53 having on its upper face side a protrusion.

The retainer 50 is assembled to the housing 40 from a side. During assembling, respective leading end portions (extending end portions) of the disconnection preventing portions 52 are advanced into the accommodation space 43, and at the beginning of the assembling, as shown in FIG. 14, the retainer 50 is held in a temporary locked position by the protrusion of the elastic locking piece 53 locking on the temporary locking portion 44. In a state in which the retainer 50 is in the temporary locked position, the disconnection preventing portions 52 are in a retracted position at which they are retracted rearward in an assembling direction (leftward in FIG. 14) from all of the cavities 41, and therefore insertion of the terminal fitting with the electric wire A into a cavity 41 is allowed.

After the terminal fittings with the respective electric wires A have been inserted into all of the cavities 41 with the retainer 50 being held in the temporary locked position, the retainer 50 is moved such that it is forced into a permanent locked position shown in FIG. 13. When the retainer 50 is moved from the temporary locked position to the permanent locked position, if part of the terminal fittings with the electric wires A has not yet reached a proper insertion position, tapered surfaces of the respective leading end portions of the disconnection preventing portions 52 apply a frontward pressing force to the secondary locking portions 27 of those terminal fittings with the electric wires A in a half-inserted state, so that the terminal fittings with the electric wires A in the half-inserted state are forced into the proper insertion position.

Figure 12:
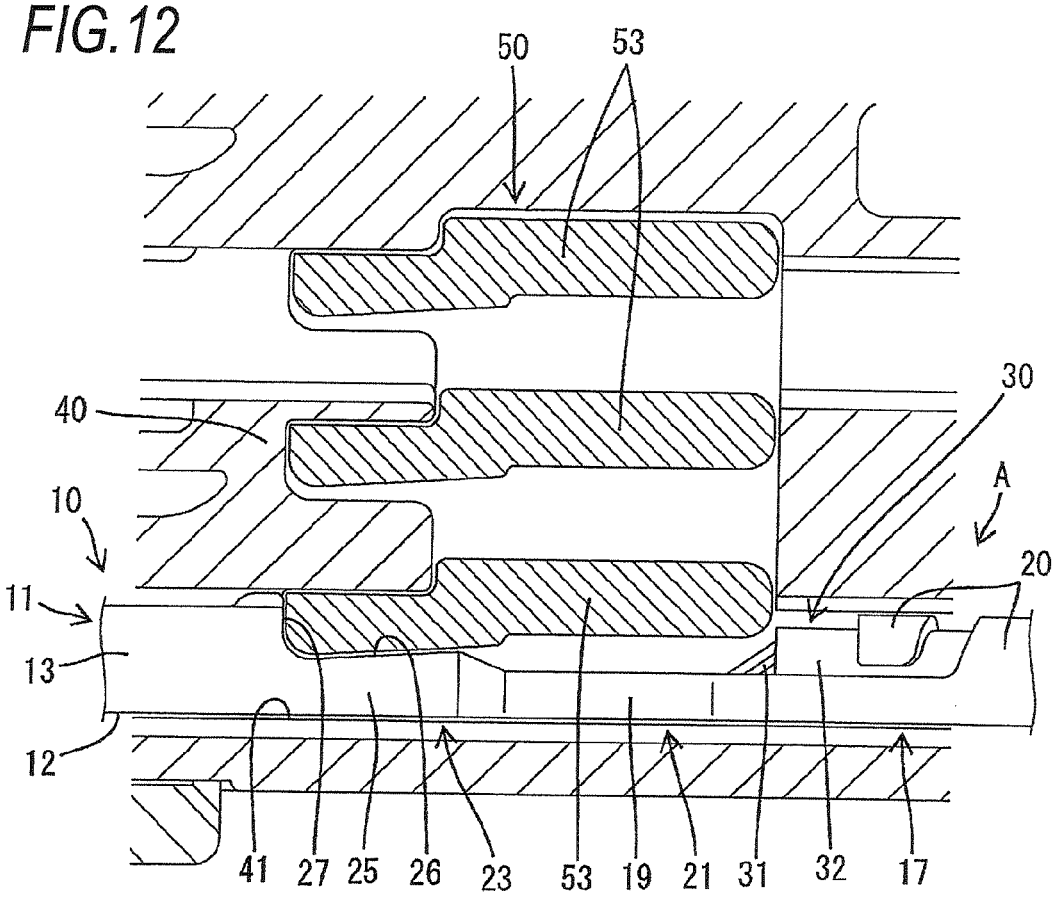
FIG. 12 is a cross-sectional view taken in a length direction of the terminal fitting, showing a state in which the terminal fitting with the electric wire is locked by a retainer.

The retainer 50 that has moved to the permanent locked position is held in the permanent locked position by the protrusion of the elastic locking piece 53 locking on the permanent locking portion 45. In this state, as shown in FIG. 12, the disconnection preventing portions 52 lock the secondary locking portions 27 from the rear or otherwise are located in close proximity to and oppose the secondary locking portions 27. The locking effect provided by the disconnection preventing portions 52 and the secondary locking portions 27 reliably prevents disconnection of the terminal fittings with the electric wires A. Moreover, the disconnection preventing portions 52 locking the secondary locking portions 27 are located in close proximity to and oppose or otherwise are in contact with the upper end edges of the reinforcing portions 26, and therefore, even if the terminal fittings with the electric wires A are improperly displaced upward within the respective cavities 41, the reinforcing portions 26 are brought into contact with the disconnection preventing portions 52, thereby suppressing or restricting the improper upward displacement of the terminal fittings with the electric wires A.

In the terminal fitting with the electric wire A of the present embodiment, the coupling portion 23 is reinforced by forming the reinforcing portions 26. The reinforcing portions 26 continuously extend from the respective front ends that are joined to the side wall portions 13 of the box portion 11 to the rear ends that are joined to the first crimping pieces 19 of the crimping portion 17 and have the regions that are bent inward, and accordingly have high rigidity and can reliably reinforce the coupling portion 23.

Moreover, since the respective front end portions of the reinforcing portions 26 serve as the stress alleviation portions 28, stress concentration on the front end portions of the reinforcing portions 26 is alleviated, and therefore deformation and the like due to stress concentration can be prevented.

Moreover, since the height of the front ends of the reinforcing portions 26 is lower than that of the side wall portions 13 of the box portion 11, the rear end edge of the box portion 11 can be made to function as the secondary locking portion 27, which is a means for locking on the retainer 50. Here, since the height of the reinforcing portions 26 gradually increases toward the rear end side, the overall rigidity of the reinforcing portions 26 is enhanced when compared to a case where the height is constant all the way from the front ends to the rear ends. Therefore, according to the present embodiment, it is possible to ensure a large locking area for locking on the retainer 50 in the rear end of the box portion 11 without decreasing the reliability of the reinforcing portions 26.

It should be appreciated that the present invention is not limited to the embodiment described above and shown in the drawings, and, for example, embodiments such as those described below are also included within the technical scope of the present invention.

In the above embodiment, the height of the reinforcing portions was increased from the front ends toward the rear ends; however, the height of the reinforcing portions may be decreased from the front ends toward the rear ends, may be constant all the way from the front ends to the rear ends, or may be changed at a location between the front ends and the rear ends.

In the above embodiment, a case where the rear end of the box portion functions as a locking portion for locking on the retainer has been described; however, the present invention is also applicable to cases where the rear end of the box portion does not function as a locking portion for locking on other members.

In the above embodiment, in the respective front end portions of the reinforcing portions, the end edges of the reinforcing portions in the upward extending direction from the bottom plate portion were curved so as to be smoothly joined to the rear end edges of the side wall portions; however, the end edges of the front end portions of the reinforcing portions in the upward extending direction may also be straight so as to be joined to the respective rear end edges of the side wall portions in an intersecting manner.

In the above embodiment, the end edges of the rear end portions of the reinforcing portions in the upward extending direction that are joined to the respective end edges of the crimping pieces in the upward extending direction were at the same level with the end edges of the crimping pieces; however, the end edges of the rear end portions of the reinforcing portions in the upward extending direction may also be lower than the end edges of the crimping pieces in the upward extending direction.

In the above embodiment, a structure that enables the retainer to be brought into contact with the reinforcing portions was used to restrict or suppress displacement of the terminal fitting within the housing; however, the reinforcing portions also may not have a function of restricting or suppressing the displacement of the terminal fitting.

In the above embodiment, the reinforcing portions were configured to be deformed and bent following the deformation and bending of the crimping pieces during the crimping process; however, the reinforcing portions may also be deformed and bent by directly applying a pressure to the reinforcing portions by press working on the applicator.

In the above embodiment, a case where the terminal fitting is a female terminal has been described; however, the present invention is also applicable to a male terminal that has at its leading end a tab and that is provided with a box portion joined to a rear end of the tab.

The invention claimed is:

1. A terminal fitting with an electric wire, comprising:

a terminal fitting that is elongated in a front-rear direction as a whole and that has an angular tube-like box portion, an open-barrel type crimping portion disposed to a rear of the box portion, and a coupling portion coupling a rear end of the box portion and a front end of the crimping portion to each other; and an electric wire that is fastened to the terminal fitting so as to connect to the terminal fitting electrically, wherein the coupling portion is approximately U-shaped with a pair of side plate portions extending upward from respective side edges of a bottom plate portion, a front end of the bottom plate portion is joined to a bottom wall portion constituting the box portion, a rear end of the bottom plate portion is joined to a mounting plate portion constituting the crimping portion, front ends of the side plate portions are respectively joined to side wall portions extending upward from respective side edges of the bottom wall portion, rear ends of the side plate portions are respectively joined to crimping pieces extending upward from respective side edges of the mounting plate portion, in the crimping portion, the electric wire is crimped by wrapping the crimping pieces around a terminal portion of the electric wire mounted on the mounting plate portion while deforming and bending the crimping pieces, and in respective end edge portions of the side plate portions in an upward extending direction, reinforcing portions are formed continuously extending from respective front ends that are joined to the side wall portions to rear ends that are joined to the crimping pieces and constituting regions that are deformed and bent inward along with respective front ends of the crimping pieces in a state in which the electric wire is crimped by the crimping pieces, and portions in which the reinforcing portions and the respective crimping pieces are continuous with each other are present in a face opposing the bottom plate portion, and wherein in front end portions of the reinforcing portions, respective end edges in the upward extending direction from the bottom plate portion are curved so as to be smoothly joined to rear end edges of the side wall portions.

2. The terminal fitting with an electric wire according to claim 1, wherein a height of the reinforcing portions relative to the bottom plate portion is lower than that of the side wall portions of the box portion at the respective front ends of the reinforcing portions and increases toward a rear end side.

3. The terminal fitting with an electric wire according to claim 1, wherein a height of the front end portions of the reinforcing portions relative to the bottom plate portion is set to be lower than that of the side wall portions of the box portion, thereby allowing a rear end edge of the box portion to serve as a locking portion, and in a state in which the terminal fitting is inserted in a housing, a retainer attached to the housing locks the locking portion from the rear, thereby preventing the terminal fitting from disengaging from the housing disconnection of the terminal fitting, and the retainer is in contact with the reinforcing portions or is located in close proximity to and opposes the reinforcing portions.

4. The terminal fitting with an electric wire according to claim 2, wherein a height of the front end portions of the reinforcing portions relative to the bottom plate portion is set to be lower than that of the side wall portions of the box portion, thereby allowing a rear end edge of the box portion to serve as a locking portion, and in a state in which the terminal fitting is inserted in a housing, a retainer attached to the housing locks the locking portion from the rear, thereby preventing the terminal fitting from disengaging from the housing disconnection of the terminal fitting, and the retainer is in contact with the reinforcing portions or is located in close proximity to and opposes the reinforcing portions.

* * * * *